US005799929A

United States Patent [19]

Meglino et al.

[11] Patent Number: 5,799,929

[45] Date of Patent: *Sep. 1, 1998

[54] FENCE SLATS WITH INTEGRAL LOCKING PORTIONS

[76] Inventors: Don A. Meglino; James V. Meglino, both of 100 Frank Rd., Hicksville, N.Y. 11802

[ * ] Notice: The term of this patent shall not extend beyond the expiration date of Pat. No. 5,794,922.

[21] Appl. No.: 766,287

[22] Filed: Dec. 13, 1996

[51] Int. Cl.[6] ..... E04H 17/00

[52] U.S. Cl. ..... 256/34; 256/32

[58] Field of Search ..... 256/34, 35, 32, 256/24, 1, 21, 22, 19

[56] References Cited

U.S. PATENT DOCUMENTS

| | | | |
|---|---|---|---|
| 3,069,142 | 12/1962 | Kessler | 256/34 |
| 3,356,343 | 12/1967 | Taylor | 256/34 |
| 3,958,794 | 5/1976 | Suprunuk et al. | 256/34 |
| 4,366,949 | 1/1983 | Staub, Sr. | 256/1 |
| 4,512,556 | 4/1985 | Meglino | 256/34 |
| 4,625,948 | 12/1986 | Lustvee | 256/22 X |
| 4,723,761 | 2/1988 | Cluff | 256/34 |
| 4,725,044 | 2/1988 | Cluff | 256/35 X |
| 4,950,098 | 8/1990 | Abbott et al. | 256/34 |
| 5,275,380 | 1/1994 | Barsby | 256/34 |
| 5,275,381 | 1/1994 | Cluff et al. | 256/35 |
| 5,458,319 | 10/1995 | Mackay | 256/34 |

*Primary Examiner*—Harry C. Kim
*Attorney, Agent, or Firm*—Galgano & Burke

[57] ABSTRACT

Fence slats for chain link fences and assemblies in which the fence slat comprises an elongate body having a pair of stops extending outwardly from the slat which form a passageway therebetween and which when such slat is slated in a channel of a chain link fence at least a portion of a link is positionable in said passageway to prevent movement of the slat from the chain link fence. In one embodiment the one of the stops is tapered to readily allow the slat to be inserted in a channel of a chain link fence and lock thereto in a snap-fit manner. In another embodiment the stops are a pair of raised circularly-shaped raised tabs.

16 Claims, 10 Drawing Sheets

FENCE SLATS WITH INTEGRAL LOCKING PORTIONS

The present invention is directed to fence slats for chain link fences and, more particularly, to fence slats comprising an integrally formed elongate body having a pair of stops extending outwardly from the elongated body which form a passageway therebetween. When such slats are inserted in a channel of a chain link fence at least a portion of a link is positionable in the passageway inhibiting removal of the slat once inserted therein.

BACKGROUND OF THE INVENTION

Chain link fences have been widely used for many years to satisfy fencing requirements. While they provide acceptable strength and durability over many years, they do not provide privacy or serve as a windbreak due to their apertured construction. Various inserts, typically referred to as "slats", have been suggested and manufactured for increasing the privacy of a chain link fence, as well as serving as a windbreak. Many early arrangements were designed to be directly connected to the link of the fence and required clamping or bending of a metal slat onto a link of the fence.

One of the inventors of the present invention overcame a problem with slats migrating upwardly and downwardly due to wind or other environmental forces which creates an unfinished uneven appearance, by providing a slat retaining means which extended through a slot in the slats and which is further described in U.S. Pat. No. 4,512,556 to Meglino, issued on Apr. 23, 1985. Other attempts to maintain the slats properly disposed in the chain link fence include a separate bottom member which attaches to the bottom of the slats. A drawback with these slats is that they require a cross-member which increases the overall cost of the fence and are time consuming to install.

Other attempts to maintain the slats properly within a chain link fence include U.S. Pat. No. 5,458,319 to Mackay which discloses a retainer device which is inserted in a groove in a slat and attaches to a link of a fence, and U.S. Pat. No. 5,275,380 to Barsby which discloses a corrugated slat having a raised rounded retaining tab having a groove which readily engages a link of a fence in a snap-fit manner. Drawbacks with the slats disclosed in Mackay and Barsby is that the slat disclosed in Mackay requires a separate element which increases the slats cost and is time consuming to install, and the slat disclosed in Barsby while easily inserted due to its design is also easily removed from the fence.

There is, therefore, a need for a fence slat which overcomes the drawbacks of the prior art by providing fence slats with integrally formed portions which readily lock a fence slat in a channel of a chain link fence and which prevent the fence slat from being removed, particularly by vandals, once it is inserted therein.

SUMMARY OF THE INVENTION

The various embodiments of the present invention provide privacy fence slats for chain link fences and fence system 5 in which the fence slats are readily insertable in a chain link fence and once fully inserted in a channel of a chain link fence are inhibited from being removed.

The present invention provides fence slats comprising an integrally formed elongated body comprising a first side comprising a first outwardly extending stop and a second outwardly extending stop. The stops are spaced from each other and define a passageway therebetween, wherein when the slat is received in a channel of a chain link, a portion of a link is positionable in the passageway to prevent the slat from being removed.

In one preferred embodiment, one of the stops has a .to tapered surface relative to the first surface of the slat to allow the slat to be readily inserted in a channel of a chain link fence. In another embodiment the stops are configured as a pair of raised circular-shaped tabs. Desirably, the pair of stops are disposed on both sides of the slat and are in alignment with each other so that the slats are reversible.

DETAILED DESCRIPTION

Figure 1:
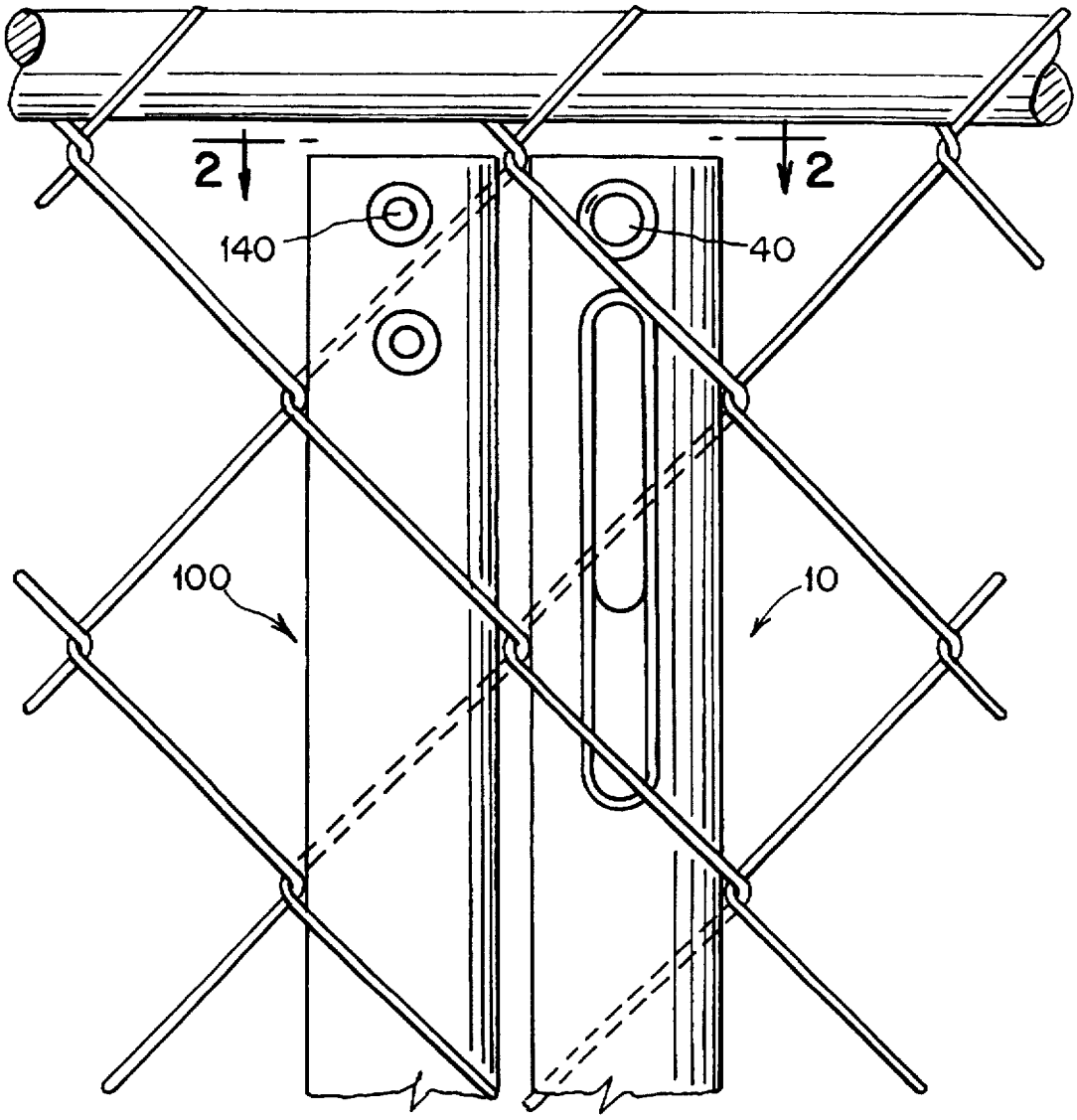
FIG. 1 is a front elevational view of two embodiments of a fence slat according to the present invention.
Figure 2:
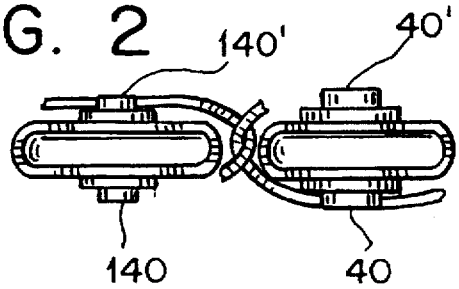
FIG. 2 is a cross-sectional view of the two fence slats shown in FIG. 1 taken along line 2—2.

Turning now to the drawings and in particular to FIGS. 1 and 2, therein illustrated are two embodiments of fence slats according to the present invention. In particular, the illustrated fence assembly shows fence slat 10 and fence slat 100 inserted in adjacent channels of a chain link fence and once received therein are inhibited from being readily removed. As best shown in FIG. 2, stops 40 and 40' of fence slat 10 and stops 140 and 140' of fence slat 100 are configured to prevent the respective slat from being removed without bending the fence. Desirably, stops 40 and 40', and 140 and 140' provide a generally vertically disposed abutment face which inhibits removal of fence slats 10 and 100, particularly by vandals, once installed in a chain link fence.

Figure 3:
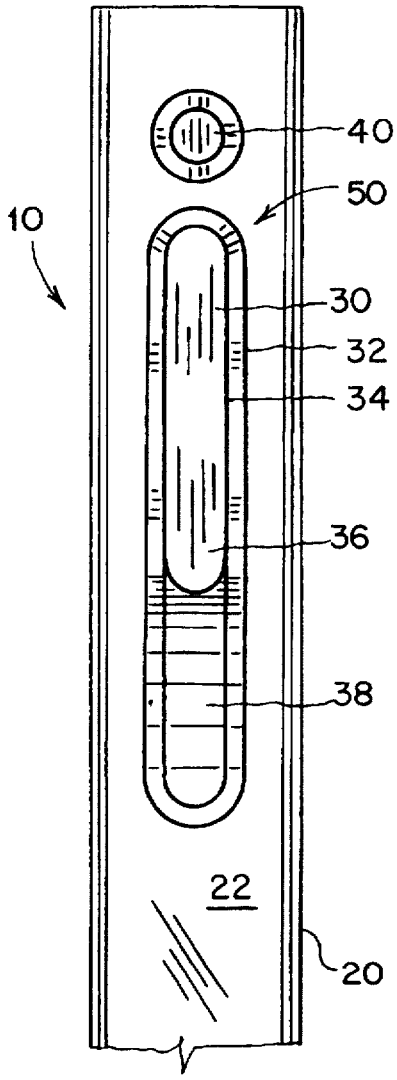
FIG. 3 is a front elevational view of one of the fence slats shown in FIG. 1.
Figure 4:
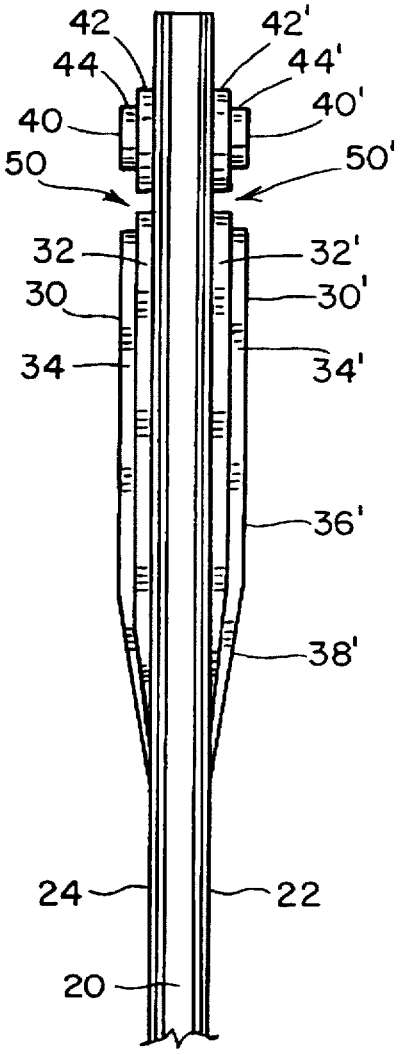
FIG. 4 is a side elevational view of the fence slat shown in FIG. 3.
Figure 5:
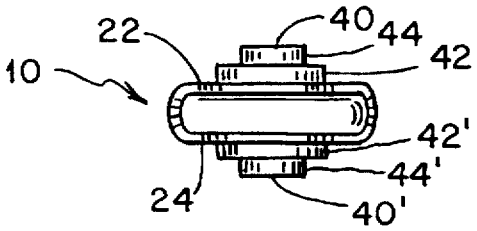
FIG. 5 is an end view of the fence slat shown in FIG. 3.
Figure 6:
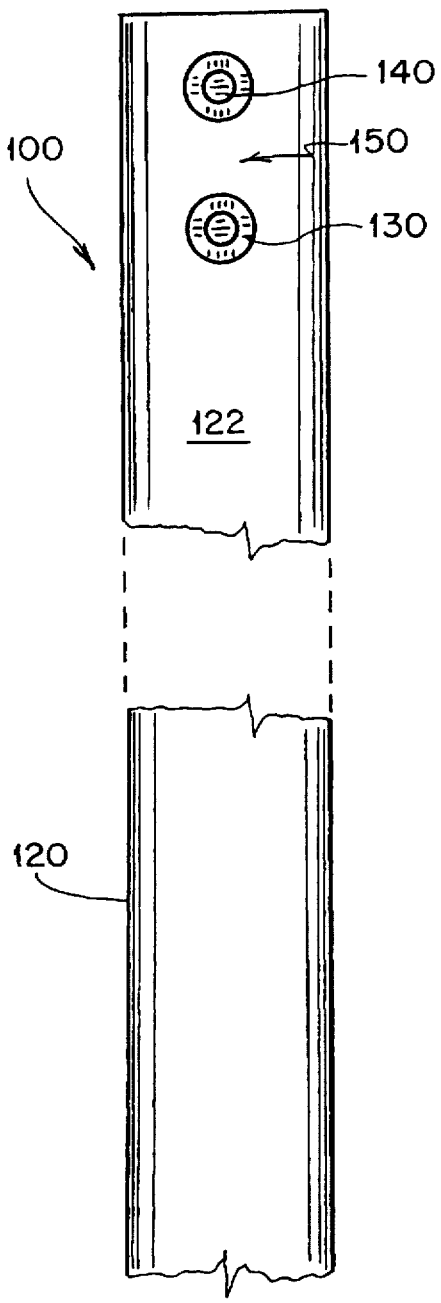
FIG. 6 is a front elevational view of the other fence slats shown in FIG. 1.
Figure 7:
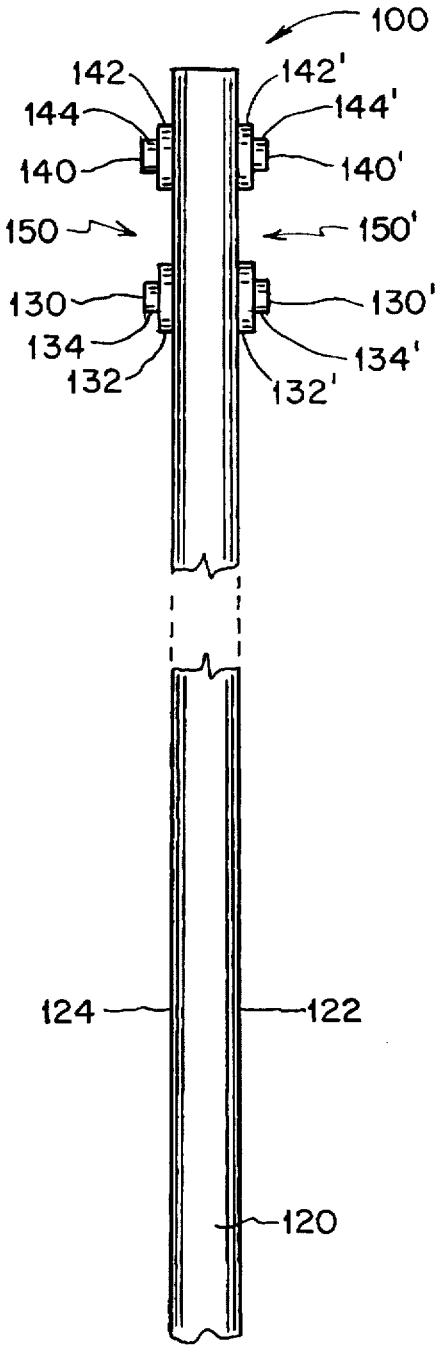
FIG. 7 is a side elevational view of the fence slat shown in FIG. 6.
Figure 8:
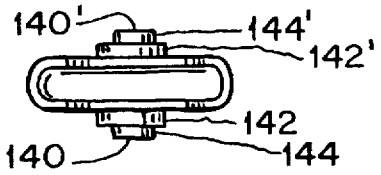
FIG. 8 is an end view of the fence slat shown in FIG. 6.

As shown in FIGS. 3–5, fence slat 10 comprises an elongated body 20 comprising a first side 22 with a first outwardly extending stop 30 and a second outwardly extending stop 40. Outwardly extending stops 30 and 40 are spaced from each other and define a passageway 50 therebetween and in which is received a portion of a link of a chain link fence (FIG.1).

In this illustrated embodiment, stop 30 comprises a base portion 32 upon which is disposed an outer portion 34.

Desirably, stop 30 is elongated, disposed longitudinally along surface 22 of the slat, and comprises a generally flat surface portion 36 and a tapered surface portion 38 to readily allow slat 10 to be inserted into a channel of a chain link fence. From the present invention, those skilled in the art will appreciate that the taper of surface 38 will facilitate the downward insertion of the slat into a fence channel.

Illustrated stop 40 is advantageously spaced from stop 30 and comprises a generally circular base 42 and a circular tab 44. Desirably, passageway 50 has a depth sufficient to receive the full diameter of a link in a chain link fence.

Advantageously, fence slat 10 is sized so as to extend between the knuckles of a chain link fence when inserted therein, and is hollow to be economically fabricated (FIG. 5). From the present description, it will be appreciated to those skilled in the art that for fence slats having a hollow configuration, base portions 32 and 42 of respective stops 30 and 40 increases the structural integrity and rigidity of the stops and better maintains the position of the stops about a link of a chain link fence when the slat is inserted therein.

Desirably, fence slat 10 comprises a pair of stops 30' and 40' disposed on the opposite side of slat 10 in alignment with respective stops 30 and 40 so that slat 10 is reversibly positionable in a channel of a chain link fence. Moreover, by positioning stop 30 on both sides of slat 10, the rearward stop 30' will urge the slat 10 forwardly and help to maintain the link of the fence securely between the stops on the front face of slat 10. This advantageous aspect of the present invention is clearly illustrated in FIG. 1.

Fence 100 illustrates alternative embodiment of the present invention in which fence slat 100 comprises an elongated body 120 comprising a pair of spaced generally circular raised stops 130 and 140 disposed on a surface 122 of elongated slat 120. Desirably, a second pair of stops 130' and 140' extend outwardly from the opposite side of elongated slat 120 and aligned with stops 130 and 140, respectively so that fence slat 100 can be reversibly inserted and maintained in a channel of a chain link fence. As in fence slat 10, stops 130 and 140 define a passageway 150 which retains fence slat 110 in a channel of a chain link fence once inserted.

Figure 15:
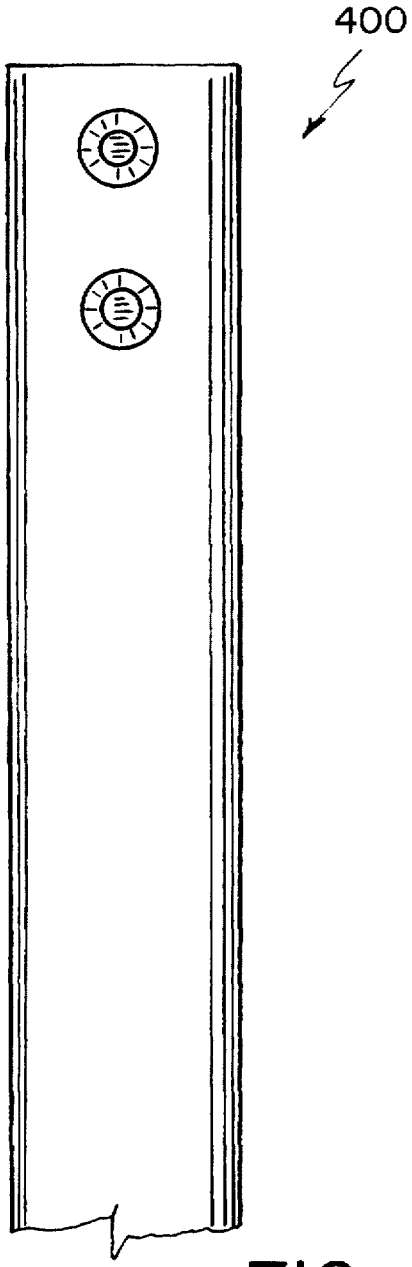
FIGS. 15–17 are a front elevational view, a side elevational view, and an end view, respectively, of another embodiment of the present invention.
Figure 16:
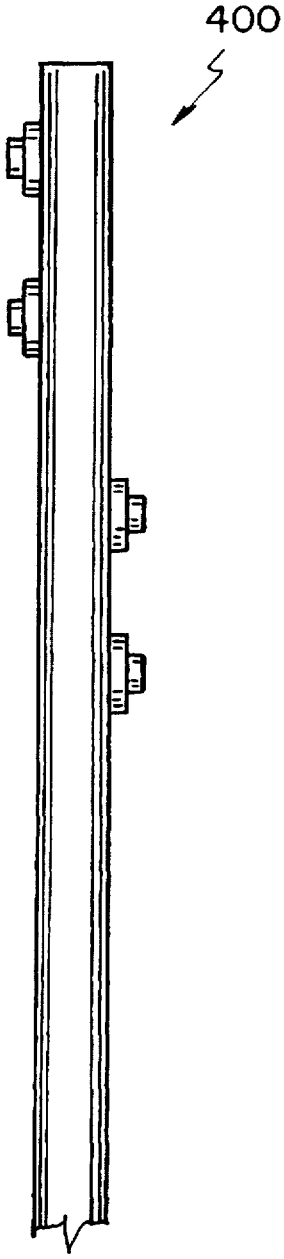
Figure 17:
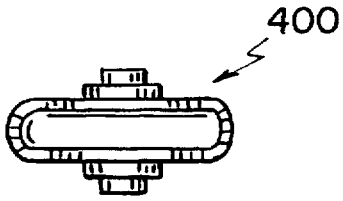
Figure 21:
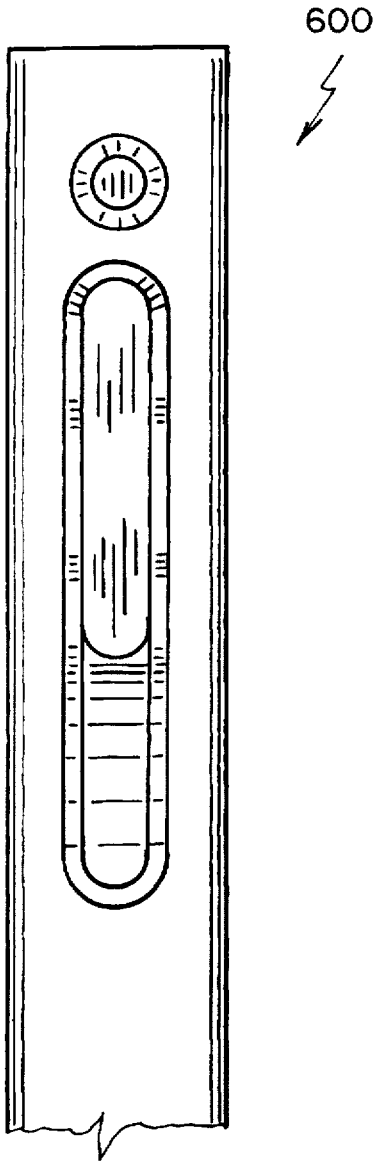
FIGS. 21–23 are a front elevational view, a side elevational view, and an end view, respectively, of another embodiment of the present invention.
Figure 22:
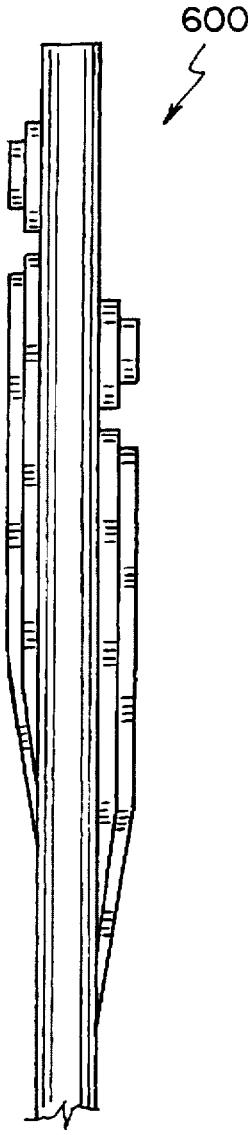
Figure 23:
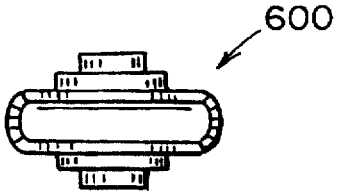
Figure 24:
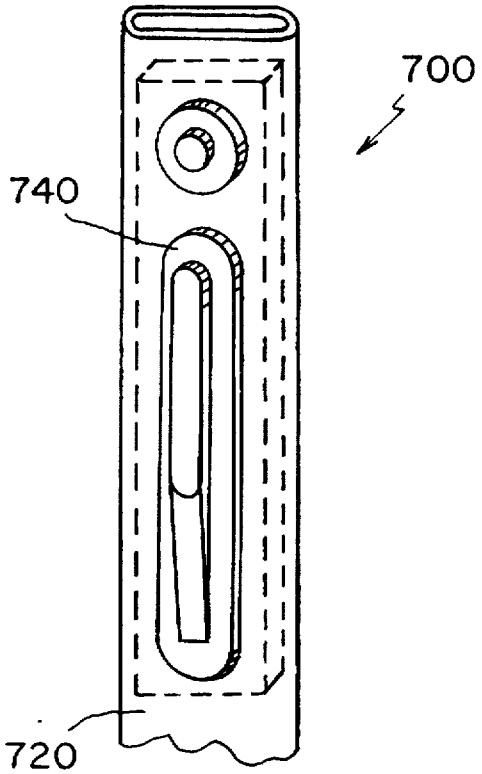
Figure 25:
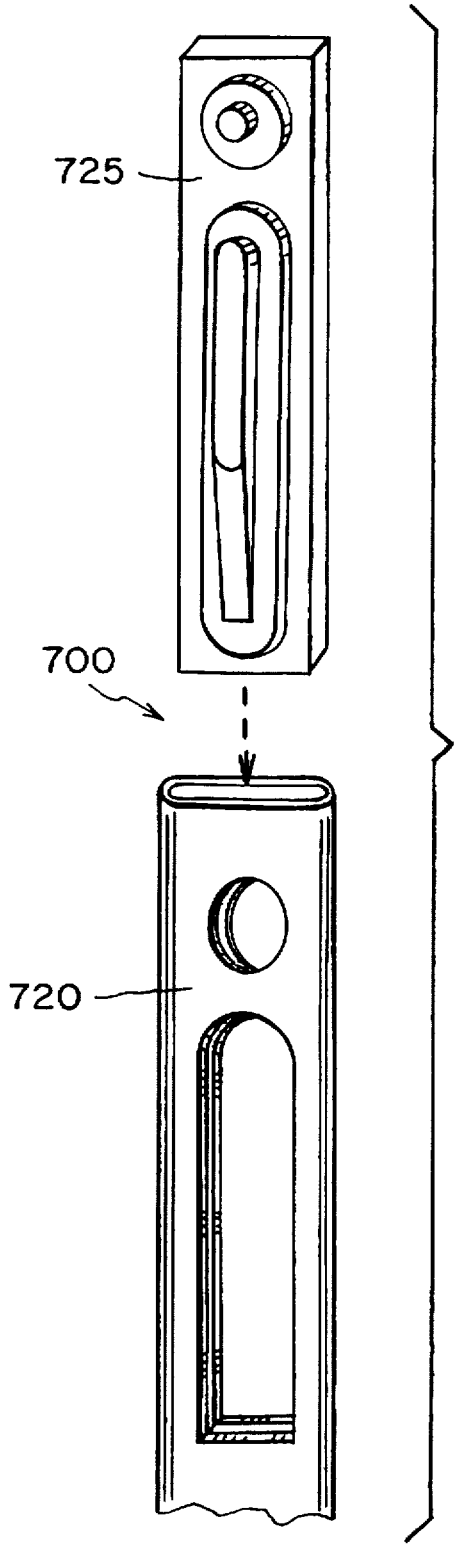
Figure 30:
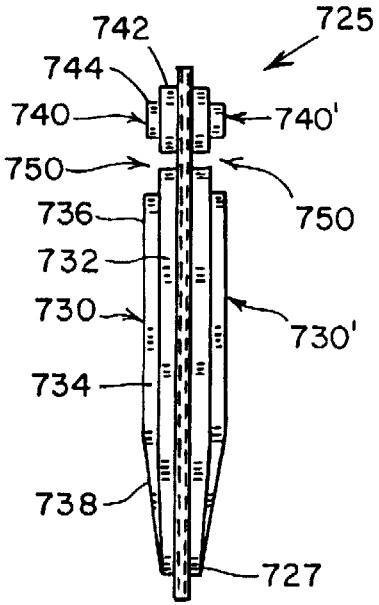
Figure 29:
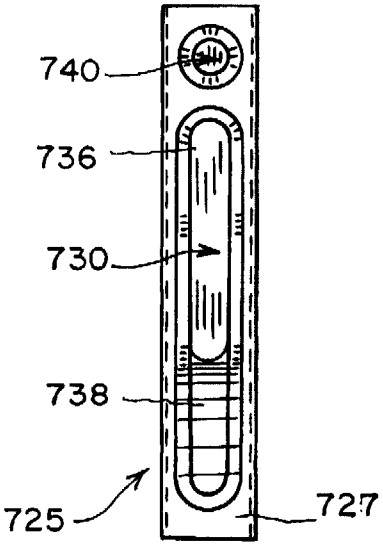
Figure 31:
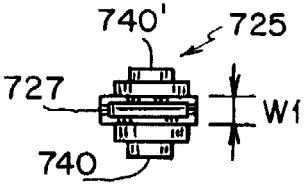
Figure 28:
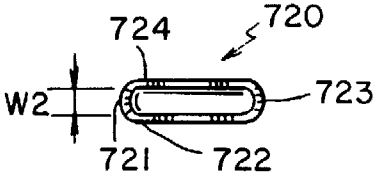
Figure 27:
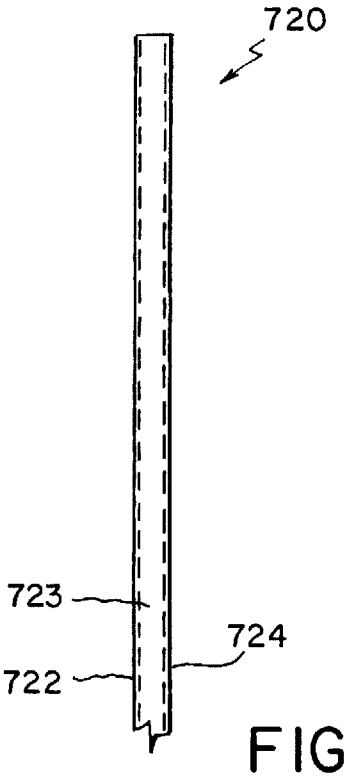
Figure 26:
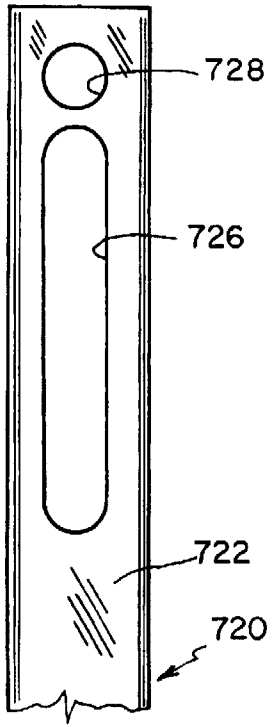

According to another embodiment of the present invention, single stops or pairs of stops are not aligned, but are offset so that a forward stop(s) engages a link on the forward surface of the slat while a rearward stop or pair of stops engages a link at an offset position on the rearward side of the slat, e.g., illustrated fence slat 400 in FIGS. 15–17, and illustrated fence slat 600 in FIGS. 21–23.

Figure 9:
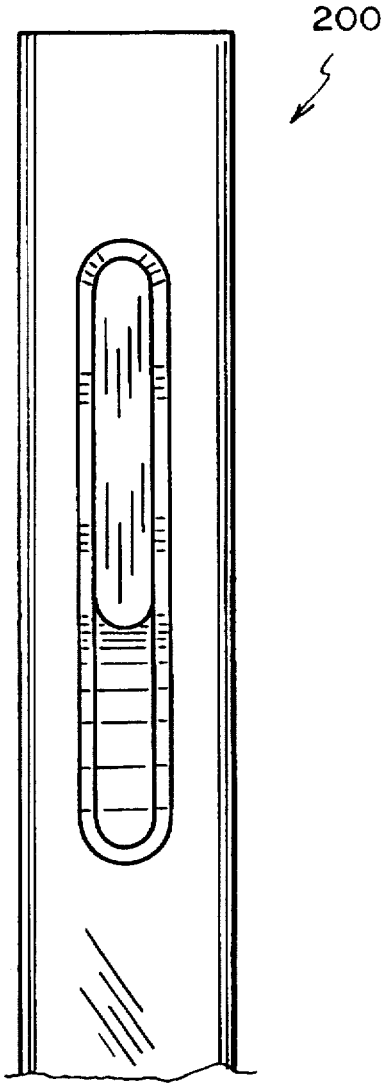
FIGS. 9–11 are a front elevational view, a side elevational view, and an end view, respectively, of another embodiment of the present invention.
Figure 10:
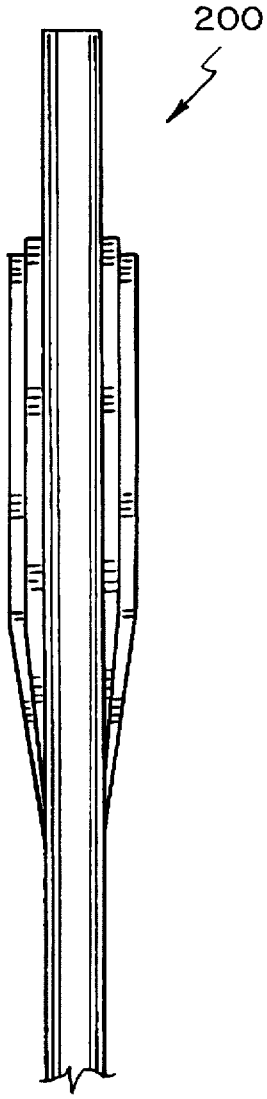
Figure 11:
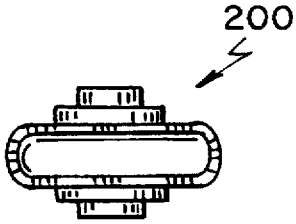
Figure 12:
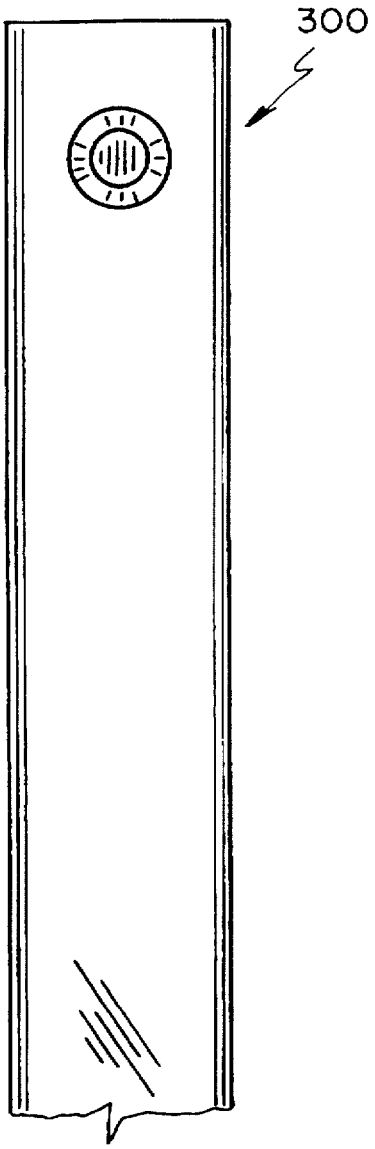
FIGS. 12–14 are a front elevational view, a side elevational view, and an end view respectively, of another embodiment of the present invention.
Figure 13:
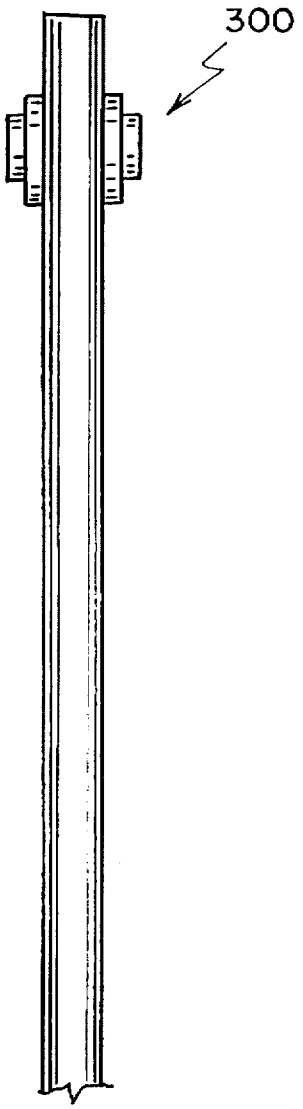
Figure 14:
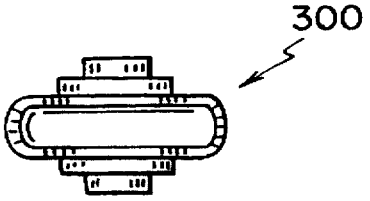

While the illustrated slats comprise two stops on each side, another preferred embodiment comprises only one stop on at least one side of the slat. This stop can advantageously prevent the slat from sliding downwardly when subject to normal environmental vibrations, e.g., illustrated fence slat 300 in FIGS. 12–14. Alternatively, depending upon how the slat is positioned relative to the fence, the stop can inhibit removal of the slat from a fence, e.g., illustrated fence slat 200 in FIGS. 9–11.

Figure 18:
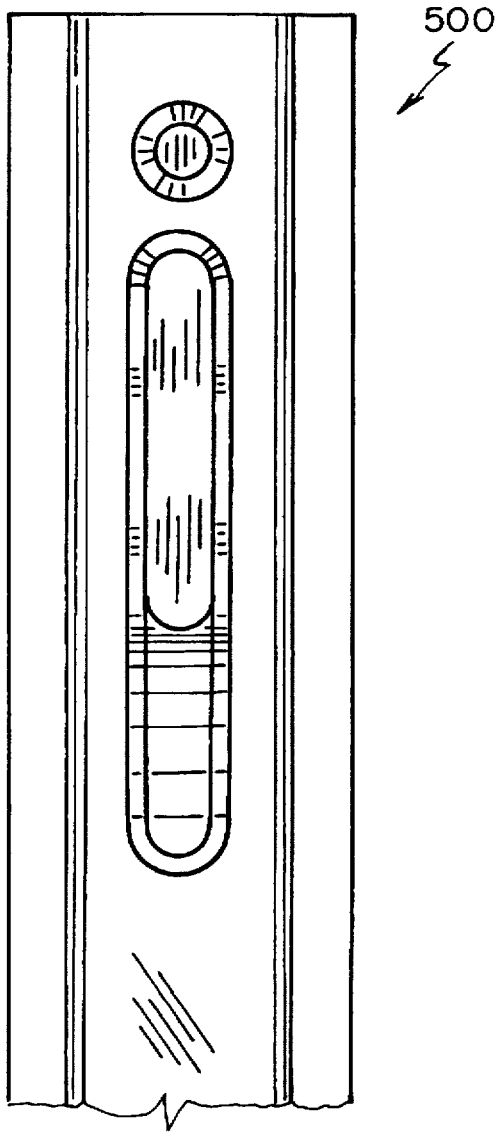
FIGS. 18–20 are a front elevational view, a side elevational view, and an end view, respectively, of another embodiment of the present invention.
Figure 19:
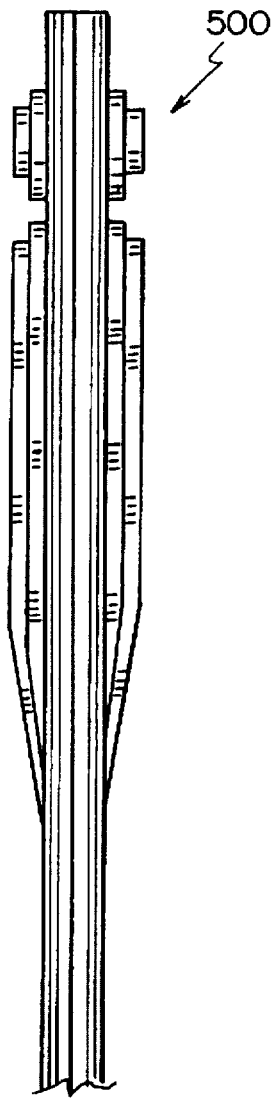
Figure 20:
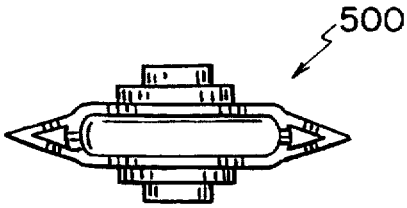

Those skilled in the art will also appreciate that the advantages of the present invention can be utilized with slats comprising wing portions which extend generally laterally, e.g., illustrated fence slat 500 in FIGS. 18–20. Furthermore, the slats of the present invention can be formed utilizing one or more materials. For example, it may be desirably to coextrude the slats using a relatively rigid material for one portion and a more resilient material for one or more other portions.

Desirably, elongated slats 20 and 120, and their respective stops are formed as an integral unit and preferably from a thermoplastic, polymeric material, e.g. polyethylene, polypropylene or combinations thereof, which may be aesthetically colored to provide a pleasing appearance.

What is claimed is:

1. A fence slat receivable in a channel formed by interwoven wires of a chain link fence, said fence slat comprising:

an elongated body comprising a first side comprising a first outwardly extending stop and a second outwardly extending stop, said first and second outwardly extending stops spaced from each other and defining a first passageway therebetween, said elongated body further comprising a second side comprising a third outwardly extending stop and a fourth outwardly extending stop, said third and fourth outwardly extending stops spaced from each other and defining a second passageway therebetween, wherein when said slat is received in the channel of the chain link fence, one of the wires is positionable in at least one of said first and second passageways.

2. A fence slat according to claim 1 wherein said first stop comprises a generally flat surface portion and a generally tapered surface portion to facilitate insertion of the slat in the channel of the chain link fence.

3. A fence slat according to claim 2 wherein at least one of said first stop and said second stop comprise an abutting surface extending generally perpendicular to the first side.

4. A fence slat according to claim 1 wherein said second stop is a generally circularly-shaped raised tab.

5. A fence slat according to claim 1 wherein said passageway has a depth substantially equal to the diameter of one of the wires in the chain link fence.

6. A fence slat according to claim 1 wherein said stops are centrally disposed longitudinally along said elongated body.

7. A fence slat according to claim 1 wherein said first stop and said third stop are offset relative to each other on opposite surfaces of said elongated body, and said second stop and said fourth stop are offset relative to each other on opposite surfaces of said elongated body.

8. A fence slat according to claim 1 wherein said first stop and said third stop are aligned on opposite surfaces of said elongated body, and said second stop and said fourth stop are aligned on opposite surfaces of said elongated body.

9. A fence slat according to claim 1 wherein said fence slat comprises polyethylene, polypropylene or combinations thereof.

10. A fence slat according to claim 1 wherein said elongated body is hollow.

11. A fence slat according to claim 1 wherein said interwoven wires define knuckles and wherein said elongated body is sized so as to be extendable between the knuckles of the chain link fence when inserted therein.

12. A fence slat according to claim 1 wherein said first and second stops are generally circularly-shaped raised tabs.

13. A fence slat according to claim 1 wherein said stops comprise a base and a generally circularly-shaped raised tabs.

14. A fence slat assembly comprising:

a plurality of interlocking chain links defining a plurality of channels; and a plurality of fence slats insertable in said channels, each slat comprising an elongated body comprising a first side comprising a first outwardly extending stop and a second outwardly extending stop, said first and second outwardly extending stops spaced from each other and defining a first passageway therebetween, said elongated body further comprising a second side comprising a third outwardly extending stop and a fourth outwardly extending stop, said third and fourth outwardly extending stops spaced from each other and defining a second passageway therebetween.

15. An assembly according to claim 14 wherein said first stop and said third stop are not aligned on opposite surfaces of said elongated body, and said second stop and said fourth stop are not aligned on opposite surfaces of said elongated body.

16. An assembly according to claim 15 wherein said first stop and said third stop are aligned on opposite surfaces of said elongated body, and said second stop and said fourth stop are aligned on opposite surfaces of said elongated body.

* * * * *